US005993151A

United States Patent [19]

Paulsen et al.

[11] Patent Number: 5,993,151

[45] Date of Patent: Nov. 30, 1999

[54] CENTRIFUGAL PUMP DEVICE

[75] Inventors: Truls Harald Paulsen; Fredrik Jahn Lebesby, both of Lier, Norway

[73] Assignee: Kvaerner Ships Equipment A.S., Lier, Norway

[21] Appl. No.: 09/117,846

[22] PCT Filed: Feb. 6, 1997

[86] PCT No.: PCT/NO97/00036

§ 371 Date: Aug. 6, 1998

§ 102(e) Date: Aug. 6, 1998

[87] PCT Pub. No.: WO97/29286

PCT Pub. Date: Aug. 14, 1997

[30] Foreign Application Priority Data

Feb. 9, 1996 [NO] Norway ..... 960528

[51] Int. Cl.[6] ..... F01B 25/06

[52] U.S. Cl. ..... 415/146; 415/199.001; 415/11

[58] Field of Search ..... 415/146, 199.1, 415/199.2, 11, 56.2, 56.4, 121.2; 417/244, 253, 423.5; 137/565.15, 593

[56] References Cited

U.S. PATENT DOCUMENTS

| | | | |
|---|---|---|---|
| 2,082,996 | 6/1937 | Wintroath | 415/146 |
| 3,807,894 | 4/1974 | O'Rourke | 415/147 |
| 3,985,094 | 10/1976 | Stricker | 115/14 |
| 5,201,633 | 4/1993 | Peu | 415/146 |

FOREIGN PATENT DOCUMENTS 423565 5/1982 Sweden .

OTHER PUBLICATIONS

Nuell–Garve, "Kreiselpumpen und Verdichter",, Stuttgart 1957, p. 90, Fig. 90.2.

*Primary Examiner*—Edward K. Look
*Assistant Examiner*—Ninh Nguyen
*Attorney, Agent, or Firm*—Merchant & Gould P.C.

[57] ABSTRACT

The invention relates to a centrifugal pump device, comprising a pump casing (1) having an inlet (2) and an outlet (3), an impeller device inside the casing (1) having one or more pump stages (5–7) with a common rotary shaft (4), and a non-return valve (8) between inlet (2) and outlet (3). The device is characterized in that the non-return valve (8) is provided on the discharge side of at least a first pump stage (5).

2 Claims, 1 Drawing Sheet

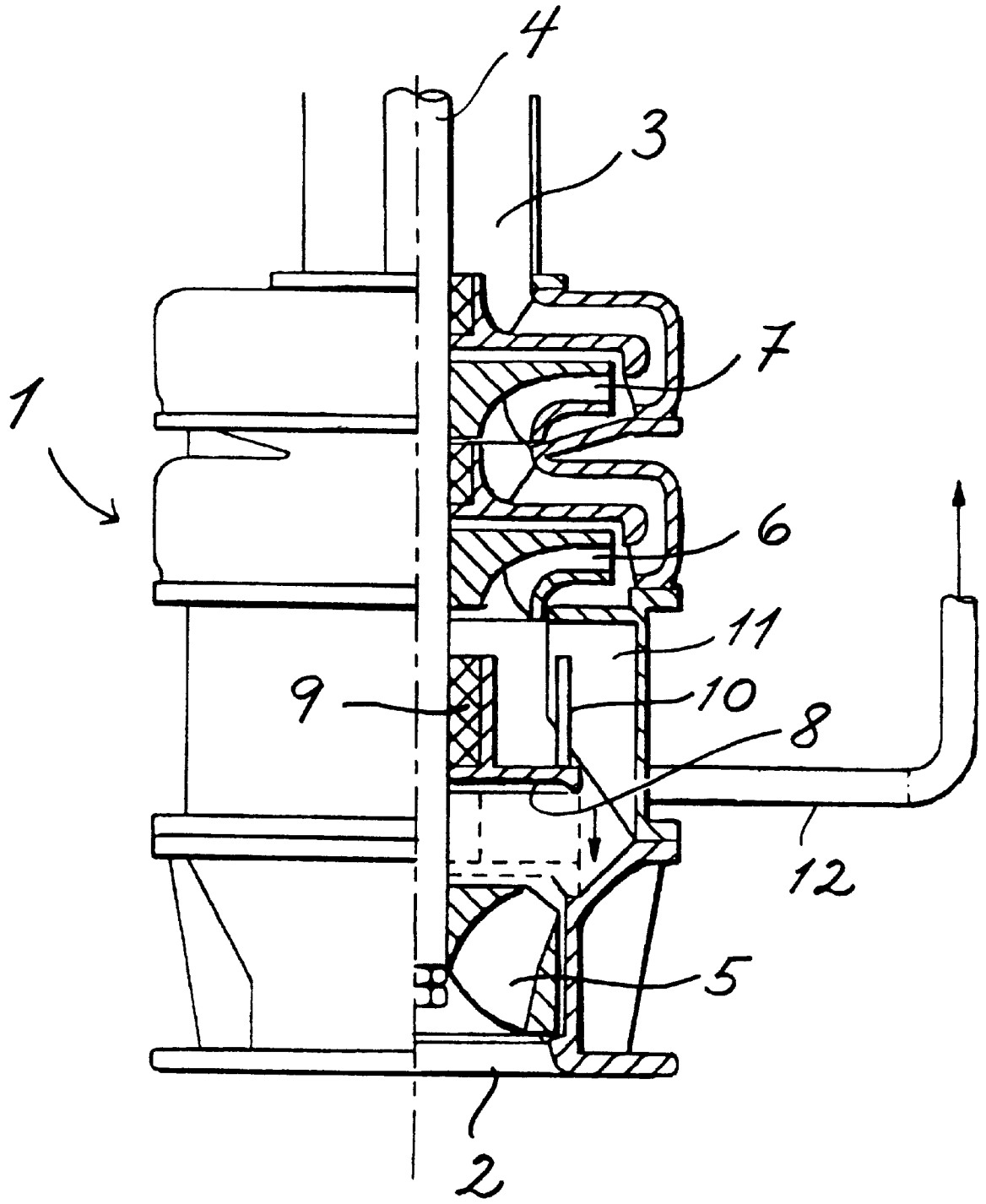
4
3
7
1
6
11
9
10
8
12
5
2

CENTRIFUGAL PUMP DEVICE

The invention relates to a centrifugal pump device which comprises a pump casing having an inlet and an outlet, an impeller device inside the casing having one or more pump stages with a common rotary shaft, and a non-return valve between the inlet and the outlet.

The invention has been especially developed in connection with so-called submerged centrifugal pumps or submersible pumps which are used for pumping cargo in ships' tanks. A particular requirement of submersible pumps arranged as unloading pumps for tankers is that they empty the cargo tank and discharge the residue of the pump medium which remains after an unloading operation has been completed.

It is known to have special inlet stages which give the pump best possible suction performance in order to empty the tank completely. These inlet stages are laid out according to the actual needs, as well known by persons skilled in the art.

It is also known to provide a foot valve, or non-return valve, in the bottom of the pump in order to prevent flow-back of pump medium after the pump has stopped, and in that way permit the residue in the pump to be discharged, so-called stripping.

It is desirable to have both these functions in unloading pumps owing to the increasingly stringent requirements for pollution-free unloading operations.

Non-return valves have a negative influence on the suction performance of the pump, and in the case of liquids having high vapour pressure and viscous liquids this may result in problems with unloading.

It is an objective of this invention to provide a centrifugal pump having a non-return valve where the non-return valve does not interfere with the critical inlet function.

A particular objective of the invention is to combine two known functions per se, namely the use of a non-return valve and inlet stage, in order to achieve thereby in a simple and improved manner efficient stripping and to obtain good suction performance.

According to the invention, a centrifugal pump device is therefore proposed comprising a pump casing having an inlet and an outlet, an impeller device inside the casing having one or more pump stages with a common rotary shaft, and a non-return valve between the inlet and the outlet, characterised in that the non-return valve is provided on the discharge or delivery side of at least a first pump stage.

By virtue of the fact that the first pump stage, which to advantage may be an inlet stage as defined above, is on the suction side of the non-return valve, this will not interfere with the critical inlet function.

The invention is primarily suitable for multistage pumps, but this is not a condition.

The non-return valve may to advantage comprise a disc body mounted for movement along the common rotary shaft. It is of particular advantage if this disc body can be freely mounted on the common rotary shaft and can be blocked against rotation. In this way a simple structural embodiment is obtained, at the same time as it is ensured that the valve disc will not become stuck because of contaminants and sticky connections.

When the pump is stopped on completion of unloading, the non-return valve will close. The residue which remains in the pump can then be forced out with the aid of a pressurised medium, which may be air, inert gas or nitrogen.

The invention will now be described in more detail with reference to the drawing, wherein the only FIGURE shows a half-section through a centrifugal pump where the invention has been implemented.

The centrifugal pump illustrated in the FIGURE has a pump casing 1 built up of several parts which are flanged together in a known way. The pump casing 1 has an inlet 2 and an outlet 3.

Inside the pump casing 1 there is an impeller device which comprises three pump stages with a common rotary shaft 4. The first pump stage is designed as an inlet stage 5, i.e., a first pump stage which gives the pump best possible suction performance in order to empty completely the non-illustrated tank. In addition, the impeller means comprises two pump stages 6 and 7.

A non-return valve in the form of a valve disc 8 is provided between the inlet stage 5 and the next pump stage 6. The valve disc 8 is freely mounted on the rotary shaft 4, and between the rotary shaft 4 and the valve disc 8 there is provided a suitable bearing 9 which functions simultaneously as a seal.

The valve disc 8 can move along the rotary shaft 4, but is prevented from rotating together therewith. Thus, in the exemplary embodiment the valve disc 8 has a pin 10 which interacts with a stop 11 inside the pump casing.

When closed, the valve disc 8 will assume the position indicated in broken lines. The non-return valve will assume this position when the pump is stopped and the through-flow ceases. A pressurised medium, e.g., air, inert gas or nitrogen, is supplied through non-illustrated pipes, which forces the residue in the pump out through the pipe 12.

It will be appreciated that the invention as shown and described using the exemplary embodiment constitutes a combination of two known functions per se, namely a non-return valve and inlet stage, in order to achieve thereby in a simple and improved manner efficient stripping and good suction performance. By virtue of the fact that the valve disc of the non-return vale is mounted on the rotating pump shaft, but secured against rotating together therewith, a simple structure is obtained, at the same time as it is ensured that the valve disc 8 does not become stuck because of contaminants and sticky connections.

Since the valve is located on the discharge side of the first pump stage, the valve will not interfere with the critical inlet function.

The disclosed pump is of the type specially designed for liquid gas, i.e. a boiling liquid. The inlet stage 5 is designed accordingly, with a large inlet diameter, so that it can handle a boiling medium (cavitation) and improve the inlet suction capability of the pump.

We claim:

1. A centrifugal pump device comprising a pump casing (1) having an inlet (2) and an outlet (3), an impeller device inside the casing (1) having a plurality of pump stages (5–7) with a common rotary shaft (4), and a non-return valve (8) between said inlet (2) and outlet (3), characterized in that the non-return valve (8) comprises a disc member (8) which is freely mounted on said common rotary shaft (4) on the pressure side of a first pump stage (5) so as to be able to move for opening/closing along said common rotary shaft (4).

2. A centrifugal pump device as in claim 1, characterized in that said disc member (8) is blocked (10,11) against rotation with the common rotary shaft (4).

* * * * *